United States Patent [19]

Bane, III

[11] 4,281,634

[45] Aug. 4, 1981

[54] WOOD BURNING SPACE HEATING STOVE

[76] Inventor: John H. Bane, III, 403 N. Maple Ave., Brunswick, Md. 21716

[21] Appl. No.: 955,647

[22] Filed: Oct. 30, 1978

[51] Int. Cl.[3] ..... F24H 9/14; F24C 1/00; F24C 15/00

[52] U.S. Cl. ..... 126/119; 126/58; 126/94; 126/98; 126/62

[58] Field of Search ..... 126/142, 118, 143, 121, 126/62, 58, 77, 83, 94, 98, 119

[56] References Cited

U.S. PATENT DOCUMENTS

| | | | |
|---|---|---|---|
| 1,716,083 | 6/1929 | Neal | 126/118 |
| 2,886,295 | 5/1959 | Betzer | 126/118 |
| 3,981,292 | 9/1976 | Lilly et al. | 126/121 |
| 4,027,649 | 6/1977 | Jackson | 126/62 |
| 4,060,068 | 11/1977 | Lever et al. | 126/143 |

*Primary Examiner*—Samuel Scott
*Assistant Examiner*—Wesley S. Ratliff, Jr.
*Attorney, Agent, or Firm*—Boris Haskell

[57] ABSTRACT

A space heating wood burning stove, formed as a rectangular fire box, having a plurality of horizontal flue ducts leading to a flue manifold, adapted to generate substantial vertical convection currents of air, and further including vertical fins to enhance said convection currents, and further including a plurality of draft valves in substantial alignment with respective ones of said flue ducts for efficient burning of wood within said fire box. Assembly of the fire box of the stove is completed under stressed conditions to prevent warping of the fire box panels from heating and cooling cycles.

7 Claims, 8 Drawing Figures

WOOD BURNING SPACE HEATING STOVE

BACKGROUND AND SUMMARY OF INVENTION

The present invention relates to space heating stoves, and particularly to improvements in such stoves for effecting efficient heat transfer from the stove into the space environs thereof. Although the present invention is described with specific reference to the preferred use of wood as the fuel for the stoves, it is apparent that the invention is not limited to the use of wood, and other fuels could be used in stoves embodying the features of the present invention.

Wood burning space heating stoves are generally well known, and their design is a highly developed art. These stoves utilize both radiation and convection modes for the transfer of heat to the environs. The radiation mode is effective in the immediate and close environs of the stove, but its effect diminishes rapidly with increased distance from the stove, and is practically nil in rooms separate from that in which the stove is located. On the other hand, the air convection mode establishes heated air currents that provide reasonably uniform heating over substantial distances from the stove, and if sufficiently efficient the heating can reach effectively into remote rooms. Therefore, it has been the object of the design of many space heating stoves to emphasize the convection mode of heat transfer.

In accordance with the present invention, the efficiency of the convection mode of heating is greatly enhanced. This is accomplished by providing a plurality of generally horizontal and laterally spaced flue ducts emerging from the stove, which are joined to a manifold at a point spaced a short distance from the stove, for conduction of the combustion gases to a stack or chimney. This structure provides a series of vertical channels defined by the spacing between the ducts and the spacing between the stove and the manifold, wherein the channels are surrounded by heated surfaces. This heat exchanger causes an organized flow of heated air to rise through these channels and to establish a significant organized convection air current. The efficiency of this heat exchange and organization of convection current is further enhanced by the positioning of elongate vertically oriented heat transfer fins within said channels.

For efficient use of wood burning space heating stoves, it is necessary to control the burning of the fuel. This is normally done by an adjustable or valved draft inlet. However, normally these stoves are provided with a single draft inlet and a single flue duct exiting from the fire box, which are normally both much smaller than the fire box and are centrally located with respect to the fire box. As a result, the flow of combustion air through the fire box is largely confined to a central area, resulting in non-uniform and inefficient burning of the fuel located to the sides of the fire box.

In accordance with the present invention, relative uniformity of burning of the fuel throughout the fire box is obtained, thereby improving the efficiency of the stove. This burning uniformity results from the use of the above-described plurality of flue ducts distributed across the top of the rear of the fire box, together with the provision of a plurality of controlled or valved draft inlets positioned across the bottom of the front of the fire box. In this manner, the flow of air is substantially uniform throughout the fire box. It is preferred that the number of draft inlets be the same as the number of flue ducts, and that they be located in corresponding alignment.

To illustrate the heating efficiency of a stove embodying the features of the present invention, a conventional six room (three bedroom) rambler, of approximately 1250 square feet, insulated in a normal manner as recommended for electric heating, was uniformly heated throughout at a temperature of 68°-74° F., over a one month period of 1194 degree days, with less than 0.6 cord of wood.

Another important aspect of space heating stoves is their aesthetic character. At the present time, these stoves are frequently used in conjunction with existing open fireplaces. It is preferred aesthetically that the stove be designed to be positioned in front of, and substantially to cover the fireplace opening, using the fireplace chimney for the stove flue. Accordingly, it is preferred that the stove be rectangular in shape. However, a rectangularly shaped fire box made of sheet steel tends to warp as a result of heating and cooling cycles.

In accordance with the present invention, however, warping is prevented by completing the formation of the six sided fire box while under two dimensional prestressing. After a five sided structure is completed—top, bottom, back and two sides—the front panel is applied. Initially, this six sided fire box is formed by spot or skip welding all seams. The two sides and the top and bottom are then stressed outwardly. While the box is retained in this stressed condition, the seams are fully welded to complete the box. The resultant built in stress eliminates any tendency of the box to warp.

It is therefore one object of the present invention to provide an efficient space heating stove.

Another object of the present invention is to provide such a stove having efficient convection heating characteristics.

Another object of the present invention is to provide such a stove having efficient fuel burning characteristics.

And still another object of the present invention is to provide such a stove of non-warping rectangular structure.

Other objects and numerous advantages of the present invention will become apparent to those skilled in the art, from a consideration of the exemplary and illustrative specific embodiment of the invention presented hereinafter.

BRIEF DESCRIPTION OF DRAWINGS

The description of the specific embodiment of the invention is had in conjunction with the accompanying drawings, in which like reference characters refer to like or corresponding parts, and wherein.

DETAILED DESCRIPTION

Figure 1:
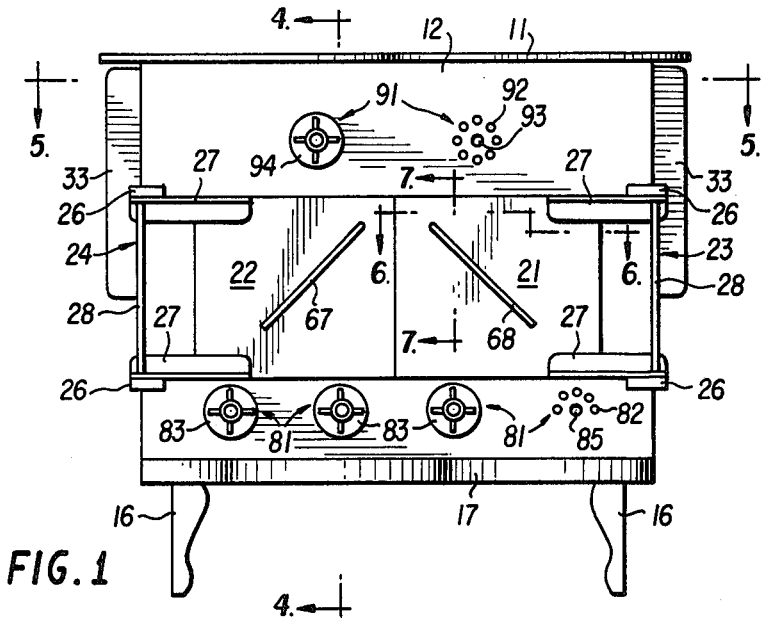
FIG. 1 is a front elevation view of a wood burning space heating stove in accordance with the present invention, with one draft control valve cover and one anti-blowback control valve cover removed for illustrative purposes.
Figure 2:
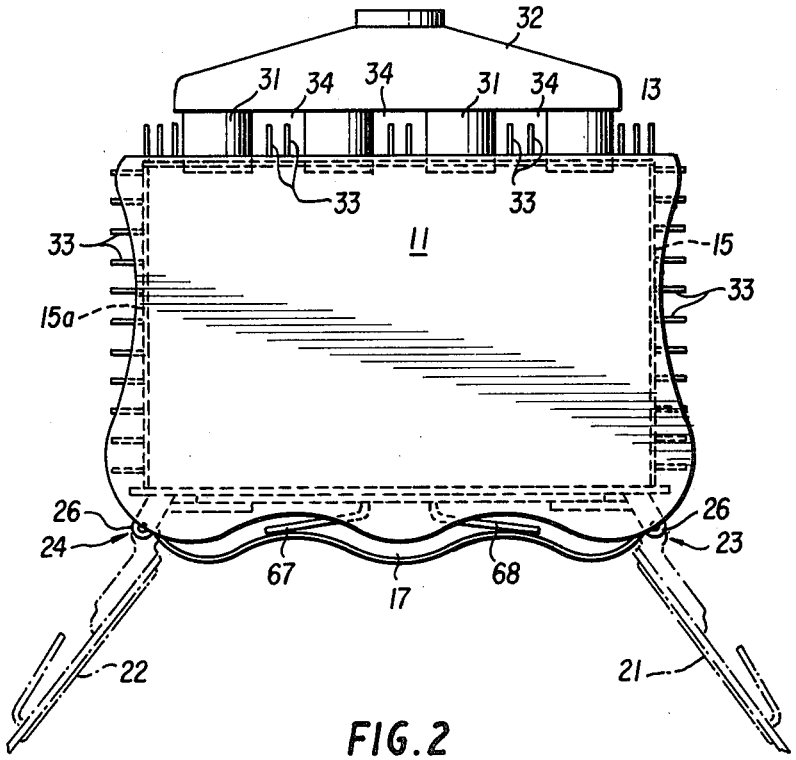
FIG. 2 is a top plan view of the said stove.
Figure 3:
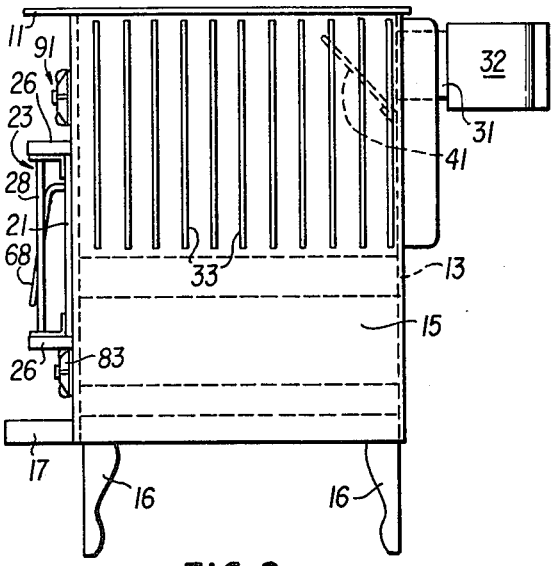
FIG. 3 is a side elevation view of said stove.

Referring to the drawings, and particularly to FIGS. 1–5, the stove comprises essentially a rectangular box formed of hot rolled or mild steel plate, or the like, having a top 11, a front 12, a back 13, a bottom 14, and two sides 15 and 15*a*. This rectangular box constitutes a fire box, and is shown supported on four feet 16. The front panel 12 supports a pair of doors 21 and 22 pivotally mounted on respective hinges 23 and 24. Below the doors is a projecting ash skirt or tray 17. In the upper portion of the back panel 13 there are positioned four spaced flue ducts 31, which lead from the interior of the fire box to a flue manifold 32 adapted to combine the flow from said ducts to a single stack or chimney. The side panels 15 and 15*a* and back panel 13 are provided with closely spaced, vertically oriented fins 33, which extend downwardly from the top of the fire box about one half the height thereof.

Figure 4:
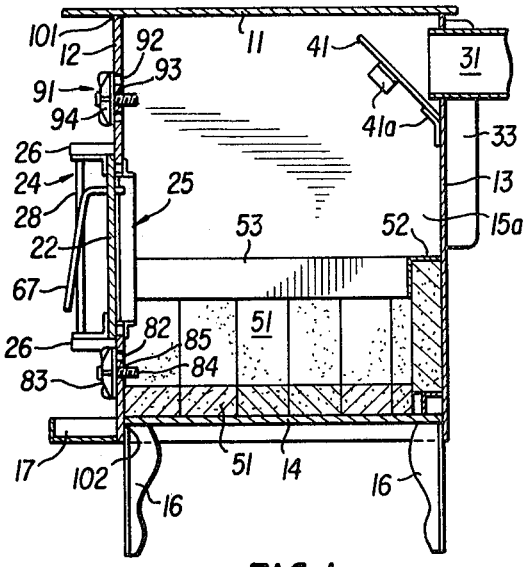
FIG. 4 is a cross sectional view taken along the line 4—4 of FIG. 1.
Figure 5:
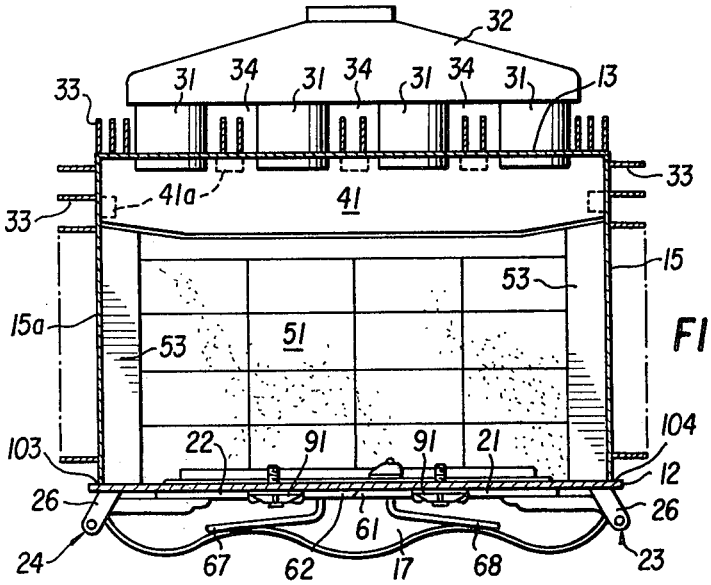
FIG. 5 is a cross sectional view taken along the line 5—5 of FIG. 1.

The interior of the fire box is shown particularly in FIGS. 4 and 5. As there shown, the structure includes an angled deflector or baffle 41 that extends across the fire box under the flue ducts 31 and rests upon brackets 41*a*. Since it is intended that the bottom half of the fire box in the fuel combustion area be lined with fire brick 51, suitable supports and brackets 52 and 53 are mounted on the interior of the rear and side panels for this purpose.

The doors 21 and 22 are pivotally mounted on the front panel by hinges 23 and 24 for opening and closing the fire box doorway 25. Each hinge is formed with a pair of spaced and opposed hinge blocks 26 that project from the front panel 12 at an outward angle so that the doors can be swung open approximately 270° to lie against the respective side panel over the projecting fins. A pair of cooperating hinge plates 27 formed preferably from angle iron stock, and ornamentally trimmed, are affixed to the door. The hinge blocks 26 and hinge plates 27 are retained in pivotal relationship by the hinge rod or pintle 28.

Figure 6:
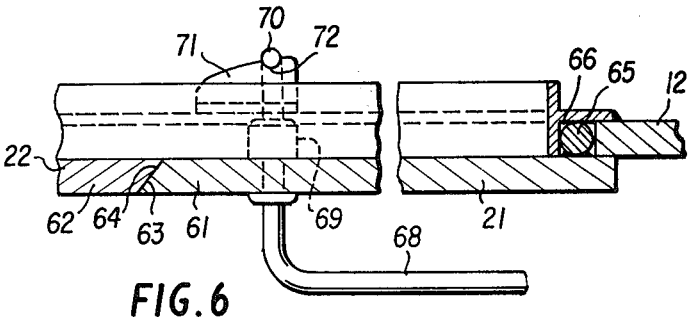
FIG. 6 is an enlarged detail cross sectional view taken along the line 6—6 of FIG. 1.

The adjacent edges 61 and 62 of the two doors 21 and 22 are formed with mating bevels 63 and 64 (see FIG. 6). The other three edges of each door are provided with an air seal in the form of a rib 65 running adjacent to but inside the perimeter of the door and interfitting with a mating channel 66 forming the inside perimeter of the opening of doorway 25. Conveniently, the rib 65 may be formed from rod stock, and the perimetric channel 66 may be formed from T stock, as shown in the drawings, or suitable angle iron stock, if desired.

Figure 7:
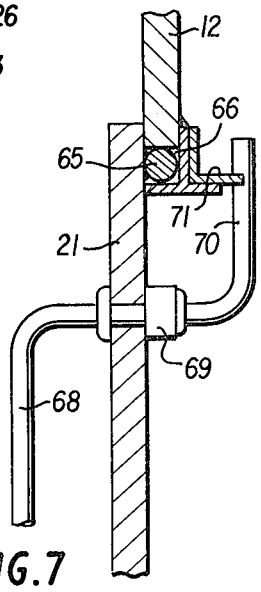
FIG. 7 is an enlarged detail cross sectional view taken along the line 7—7 of FIG. 1.
Figure 8:
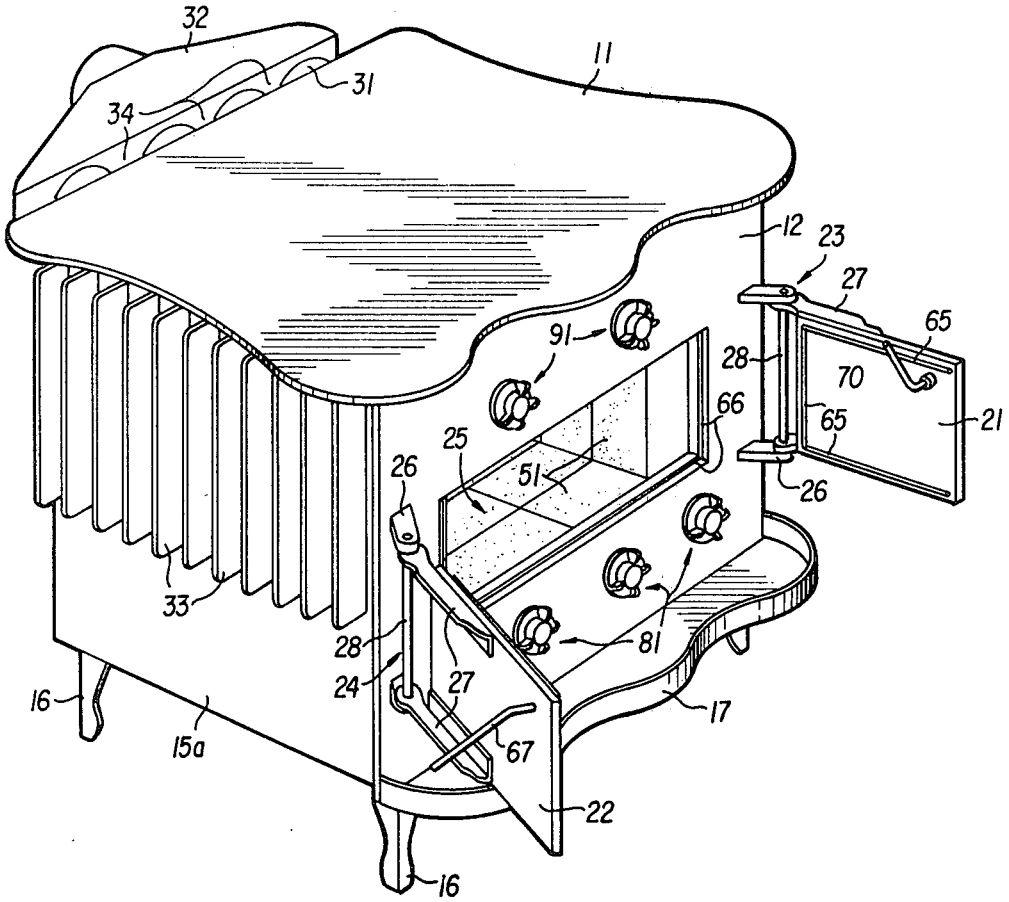
FIG. 8 is a perspective view of the stove of FIG. 1 with the doors open.

Each door is provided with a handle. Handle 67 on door 22 is a fixed or stationary handle, while handle 68 on door 21 is a rotatable latching handle. As shown in FIGS. 6 and 7, handle 68 may be formed from rod stock, and is bent to pass through the door 21 and boss 69 and is rotatably mounted therein; and is then bent to form the latch pin portion 70 which engages the cam plate 71. Thus, from the latched position shown in FIG. 1, if the handle 68 is rotated counterclockwise approximately 180°, door 21 may be pulled open, leaving door 22 free to be opened. After door 22 is closed, door 21 is closed, and handle 68 is rotated clockwise to the position shown in FIG. 1. In so doing, latch pin 70 engages the cam plate 71, and as it is forced along the cam surface into the latching recess 72, door 21 is drawn tightly against the front panel 12. The bevel surface 63 of door 21 seals and presses against the bevel surface 64 of door 22, thereby forcing door 22 tightly against the front panel 12. Sealing ribs 65 are caused to mate with the grooves 66. Thus, a reasonably air tight closure is formed by the doors 21 and 22.

In order to maximize the convection transfer of heat from the stove to the space environs, the side and rear panels 15, 15*a* and 13 are provided with fins 33, extending vertically from the top of the stove down about half the height of the stove. The fins are further oriented in closely spaced planes that are preferably parallel and are perpendicular to the respective panels. Thus, when there is fire in the stove, these fins define a series of heated vertical channels, which generate an upward convection flow of air. In addition, many of the fins 33 on the back panel 13 are located in the vertical channels 34 formed by the flue ducts 31 and their manifold 32. Thus, the flue heat is added to the fin heat, to provide a concentrated heating of air in channels 34, and the orientation of the fins in these channels combines to effect a maximum and organized convection of air flow. The foregoing fin and flue duct structure provides a most efficient and effective convection transfer of heat to the environs of the stove.

A plurality of draft control valves 81 are located along the bottom portion of the front panel 12, under the fire box doors 21 and 22, four being provided in the embodiment shown in the drawings. Each draft control valve comprises a pattern of apertures 82 forming air vents, and a threaded aperture 85 in the center of the pattern. A disc-like cover plate 83 adapted to overlie the aperture pattern 82 has a threaded stud 84 that engages with the threaded aperture 85, whereby the cover plate may be adjustably positioned toward or away from the pattern of apertures 82. In this manner the draft through the apertures 82 can be valved to any desired degree, from completely closed to any desired degree of opening.

In the present embodiment four draft control valves are shown, and each is in alignment with a respective flue duct 31. The use of a plurality of draft control valves and a plurality of flue ducts, both distributed across the fire box, contributes to a uniform and efficient combustion of the fuel in the fire box, as a controlled draft is provided across the entire fire box. By positioning each draft control valve to be in alignment with a respective flue duct, as shown, the uniformity of draft across the fire box is maximized.

It will be observed from FIG. 4 that the draft control valves 81 are located to place the aperture pattern 82 just above the layer of fire brick 51 resting on the bottom of the fire box. This is done so the wood fuel can be burned efficiently directly on the fire brick, providing a layer of ash and charcoal as the fire bed. The air supply being admitted just above the surface of the brick produces the favorable condition of having the air pass through the fire bed of ash and charcoal, rather than being drawn directly into the space above the fire bed, as in prior stoves.

An additional set of valves 91 are provided at the top of the front panel 12. These are very similar to the draft control valves, having a pattern of apertures 92, a central threaded aperture 93, and a disc-like cover plate 94 identical to draft control cover plate 83, to be threaded in aperture 93. These valves 91 are anti-blowback vents, to prevent soot and smoke from blowing back when the doors 21 and 22 are opened. Valves 91 are normally closed. Before doors 21 and 22 are opened, these valves are opened, permitting a supplemental flow of air into the top of the fire box to sweep hot gases and smoke out the flue. The valves are then closed, and the doors can then be opened safely.

A safety feature of the present invention resides in the scalloped edge design of the top panel 11 projecting outwardly beyond the side and front panels. This curvilinear overhanging design provides heat dissipation that reduces the possibility of burns from accidental contact with the stove, and of course eliminates sharp corners.

The stove herein described is made from hot rolled or mild steel plate, and the various parts that are permanently and fixedly related, are secured by welding. For structural as well as aesthetic qualities, the top and front panels should be at least about 50% thicker than the side, back and bottom panels, e.g. three eights and one quarter inch steel plate. The front panel 12 is dimensioned so that its ends extend slightly beyond the side panels 15 and 15*a*, and its bottom edge extends slightly beyond the bottom panel 14. The top panel 11 is dimensioned to extend somewhat beyond all four vertical panels. In the manufacture of the stove, the top 11, two sides 15 and 15*a*, back 13 and bottom 14 panels are skip welded together to form a five sided box. Then the front panel 12 is skip welded in place to the top, two side, and bottom panels. Two jacks are inserted in the stove through the opening 25, and one is braced across the stove between the two side panels 15 and 15*a*, stressing them outwardly, and the other is braced between the top panel 11 and the bottom panel 14, also stressing them outwardly. Because the top and front panels are substantially heavier than the remaining panels, this stressing causes a slight outward bowing of the side and bottom panels, but has essentially no effect on the top and front panels. With the stove in this stressed condition, final welding of the front panel 12 in place is completed along the exterior corners that are formed with the top panel at 101, with the bottom panel at 102, and with the side panels at 103 and 104. Also the remaining weld seams are completed. After stress relieving and cooling of the welds, jacks are removed. This prestressing of the stove biases the panels with a slight outward bow that prevents them from later warping when the stove is subjected to heating and cooling cycles.

Having thus described in detail one specific embodiment of the invention, it is understood that this embodiment is presented only by way of example, and numerous modifications and variations will be apparent to those skilled in the art. Such modifications and variations as are embraced by the spirit and scope of the appended claims are contemplated as being within the purview of the present invention.

What is claimed is:

1. A space heating stove comprising a fire box having substantially vertical front and rear panels, a plurality of substantially horizontal flue ducts positioned across the top of the rear panel in spaced relationship to each other and extending outwardly from said rear panel, a manifold spaced outwardly from said rear panel and interconnecting said flue ducts, providing vertically oriented channels formed between adjacent ones of said flue ducts and said manifold and rear panel to generate a substantial convection current of ambient air therein from the space to be heated by said stove.

2. A space heating stove as set forth in claim 1, and further including vertically oriented fins in said channels.

3. A space heating stove as set forth in claim 2, wherein said fins are affixed to said rear panel and are oriented in substantially parallel planes substantially perpendicular to said rear panel.

4. A space heating stove as set forth in claim 3, and further including a pair of side panels for said fire box, a plurality of closely spaced additional fins affixed to each of said side panels, said additional fins being oriented substantially vertically and in substantially parallel planes substantially perpendicular to said side panels.

5. A space heating stove comprising a fire box having front, side, top, bottom and rear panels, a plurality of flue ducts positioned across the top rear of said box in spaced relationship to each other, and an equal number of draft openings and control valves therefor positioned across the bottom front of said box in spaced relationship to each other and substantially in line with said flue ducts.

6. A space heating stove as set forth in claim 5, wherein each of said draft control valves comprises at least one aperture in said front panel, and a cover plate mounted on said front panel in overlying relationship to said aperture for movement toward and away from said aperture and front panel for closing and opening said aperture.

7. A space heating stove as set forth in claim 1 or 5, and further including a doorway in said front panel and a hinged closure for said doorway, the frame of said doorway having a perimetric channel, said closure having a perimetric rib adapted to fit in said channel when said closure is closed, a pivotal handle mounted on said closure, a latch pin extending from said handle interiorly of said closure, and a latch cam plate mounted adjacent the perimeter of said doorway adapted to be engaged by said pin when said closure is closed and said handle is pivoted to a latching position.

* * * * *